United States Patent [19]

Brochard

[11] 4,179,149

[45] Dec. 18, 1979

[54] SUSPENDED SEIZING DEVICE OR THE LIKE

[75] Inventor: Félix A. Brochard, Nantes, France

[73] Assignee: Brissonneau & Lotz Marine S. A., Carquefou-Nantes, France

[21] Appl. No.: 911,942

[22] Filed: Jun. 2, 1978

[51] Int. Cl.[2] ..... B66C 1/66

[52] U.S. Cl. ..... 294/81 SF; 294/67 DA

[58] Field of Search ..... 294/63 R, 66 R, 67 R, 294/67 DA, 81 R, 81 SF, 86 R; 214/621

[56] References Cited

U.S. PATENT DOCUMENTS

| | | | |
|---|---|---|---|
| 3,101,967 | 8/1963 | Wyrough | 294/67 DA |
| 3,453,017 | 7/1969 | Nagy | 294/81 SF X |
| 3,799,601 | 3/1974 | Johansson et al. | 294/81 SF |
| 3,868,139 | 2/1975 | Drelicharz | 294/81 SF |

*Primary Examiner*—Johnny D. Cherry

*Attorney, Agent, or Firm*—Wenderoth, Lind & Ponack

[57] ABSTRACT

The device comprises a frame adapted to be brought by a handling machine into a position of coincidence defined by at least one locating element, for example an edge of a container, and at least two arms disposed along a side of the frame. The arms are adapted to be placed against the locating element in the position of coincidence. The two arms are interconnected by a flexible and elongated guiding element which is adapted to cooperate with the locating element so as to guide the frame toward the position of coincidence.

12 Claims, 10 Drawing Figures

SUSPENDED SEIZING DEVICE OR THE LIKE

BACKGROUND OF THE INVENTION

The present invention relates to a suspended seizing device or the like of the type comprising a frame adapted to be brought by a handling device to a position of coincidence defined by at least one locating element, for example an edge of a container, and at least two arms disposed along a side of the frame adapted to be placed along the locating element in the position of coincidence.

A seizing device of this type is known which comprises, at each corner of the frame, a lock whose bolt is adapted to engage in a corner box forming a keeper of a rectangular container. Bearing in mind that the tolerances of the keeper and bolt are very narrow compared to the general dimensions of the frame, it will be understood that the movements that the crane operator must produce to make the frame and the container coincide exactly are extremely delicate. In order to facilitate these movements, there are provided on the frame pivotal arms which are pivotable between a raised position in which they are inscribed within the overall size of the frame and a lower position in which these arms can bear against the edges of the container in the vicinity of the corners of the latter. As the case may be, there may be provided, at each corner of the frame, a single arm which terminates at its end in an L-shaped member adapted to bear against the adjacent edges of a corner of the container, or two pivotal arms pivotable in two perpendicular directions and terminating in a shoe capable of bearing against a corresponding one of the sides of the aforementioned corner. However, although these arms ensure the precise final positioning of the frame with respect to the container, they are insufficient to really facilitate the approach movements toward this position. Indeed, if, as can be seen in FIG. 7 of the accompanying drawings, the frame is brought in such manner to the container that a single one of its pivotal arms in the lower position bears against an edge of the container, the other arm located on the same side of the length of the frame is inoperative and the frame consequently has a tendency to pivot about its bearing point when the movement of translation effected with the crane is pursued. The crane operator must then recommence the movement in such manner as to bring the two aforementioned arms against the edge of the container, which constitutes a delicate operation which, in certain cases, can only be successful after several attempts. Moreover, when the containers are disposed on the deck of a boat with a very small gap between two containers and the latter has only one side free, the longitudinal positioning of the frame on a container is hindered by the presence of the two adjacent containers, since the arms of the frame intended to bear against the side of the width of the container cannot be lowered. Furthermore, some containers have no lateral wall and merely comprise corner posts which renders the arms of the frame ineffective for the guiding toward the position of coincidence.

SUMMARY OF THE INVENTION

An object of the present invention is to provide a suspended seizing device or the like of the aforementioned type for positioning the frame on a container of any type without any outside assistance and within a very short period of time.

According to the invention, there is provided a seizing device or the like of the aforementioned type, wherein the two arms are interconnected by a flexible and elongated guiding element adapted to cooperate with the locating element for guiding the frame toward the position of coincidence.

BRIEF DESCRIPTION OF THE DRAWINGS

Further features and advantages of the invention will be apparent from the ensuing description with reference to the accompanying drawings which are given solely by way of example and in which.

DETAILED DESCRIPTION OF THE INVENTION

Figure 1:
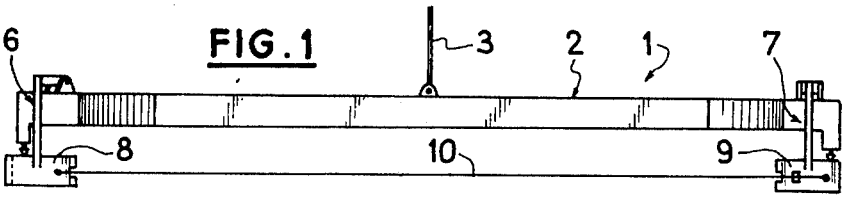
FIG. 1 is a diagrammatic side elevational view of a seizing device according to the invention.
Figure 2:
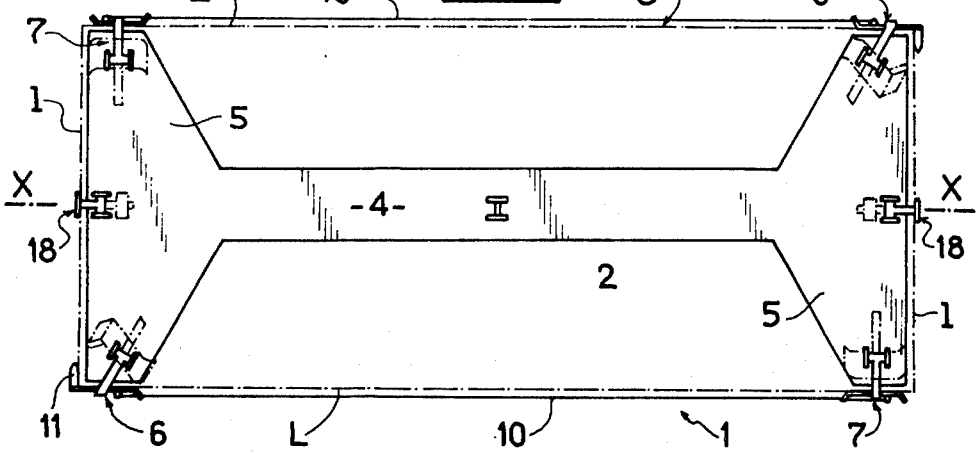
FIG. 2 is a top plan view of the device shown in FIG. 1.

With reference to FIGS. 1 and 2, there is shown a seizing device 1 comprising a frame 2 suspended at its geometric centre from a crane (not shown) by means of a cable 3. This frame 2 is formed by a centre girder 4 which terminates at each end in an enlarged portion 5 having two corners the sides of which are at right angles and form with the two corners of the other enlarged portion the four corners of a rectangle whose dimensions are substantially equal to those of the containers to be handled. Pivotally mounted at each of the corners of the frame 2 is an arm 6, 7 which is movable between a raised position shown in dot-dash lines and a lower position shown in full lines. These arms carry at their free end a shoe 8, 9 which is adapted to bear alongside a large side L of a container C in the position of coincidence of the seizing device 1 with this container, the two arms 6, 7 disposed along the same large side L of the container being interconnected by a cable 10.

Figure 4:
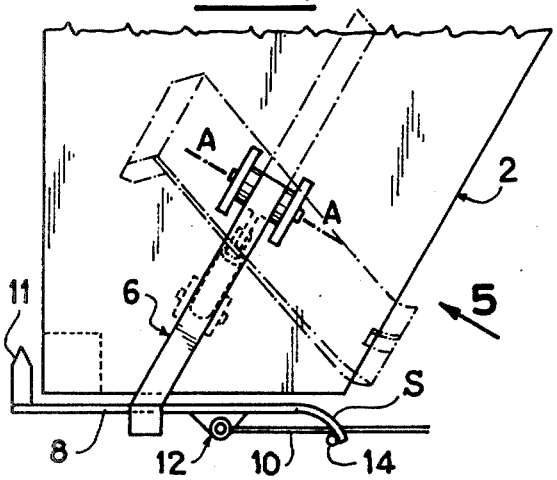
FIG. 4 is a top plan view of the arm shown in 3.

As can be seen also in FIGS. 2 to 5, two of the arms 6 which are diagonally opposed on the frame 2 are mounted to be pivotable about an axis A—A parallel to the general plane of the frame but oblique with respect to the sides of the adjacent corner of the frame. Each of the arms 6 is cranked and its shoe 8 is extended, at one end, by a spatulate portion S which is outwardly curved and, at its other end, by a projection 11 which is disposed at right angles and adapted to bear against the small side 1 of the container in the lowered position of the arm 6. The cable 10 is secured to the outer face of the shoe 8 by suitable means 12 and extends through a slot 13 formed in the spatulate portion S in which it is retained by a cross-member 14. The movement of the arm between its lowered position and its raised position is controlled by a fluid motor or jack 15 which is pivotally mounted respectively on the frame 2 and on the arm 6 and remote-controlled by suitable conventional means (not shown). As can be seen in FIG. 4, the shoe 8 is secured obliquely on the arm 6, relative to the general longitudinal plane of the latter, in accordance with a geometric disposition relative to the pivot axis A—A of this arm 6 which is such that, in the lowered position of the arm, the shoe 8 is perfectly parallel to the large side of the frame 2 and the projecting portion 11 is perfectly parallel to its small side and that, in the raised position, the assembly comprising the cranked arm 6, the shoe 8 and the projecting portion 11 is wholly inscribed within the rectangle defined by the aforementioned four corners of the frame 2.

Figure 6:
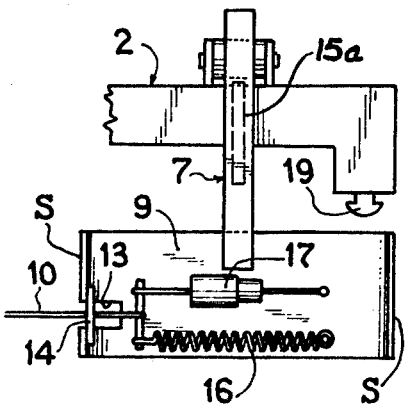
FIG. 6 is a side elevational view of another pivotal arm on the same side of the frame as the arm shown in FIGS. 3 to 5 and connected to the latter arm by a cable.

At its other end, each cable 10 is secured by a spring 16 and, if desired, a shock-absorber or damper 17 mounted in parallel, to the shoe 9 which terminates at each end in an outwardly curved spatulate portion S. In the same way as its end secured to the shoe 8, the cable 10 extends through a slot 13 in which it is retained by a cross-member 14. The pivot axis of the arm 7 carrying the shoe 9 is parallel to the plane of symmetry of the frame and makes an angle with the horizontal plane of this frame, and the outermost end edge of the shoe 9 extends in alignment with or slightly set back from the small side of the frame 2 so that, in the raised position, the arm 7 and the shoe 9 are completely inscribed within the aforementioned rectangle. The arm 7 is also controlled by a linear or rotary fluid motor, shown schematically at 15*a* in FIG. 6 and which may be similar to jack 15, adapted to be actuated by suitable means (not shown) simulaneously with the arm 6 to which it is connected by the cable 10.

A pivotal arm 18 terminating in a flat shoe is also provided in the middle of each small side of the frame. These arms 18 are mounted to pivot about an axis parallel to the aforementioned small side and may be actuated separately by linear or rotary fluid motors (not shown) between a raised position in which they are completely inscribed within the aforementioned rectangle, and a lower position in which their pallets can bear against the small side 1 of the container C to be raised.

For the purpose of raising the containers, there is provided in the lower part of each corner of the frame 2 a lock whose oblong bolt is adapted to engage in a small oblong slot (not shown) of a corner box 20, forming a keeper, of a container. Upon engagement of the bolts 19 in the keepers 20, the frame 2 is locked to the container C by a rotation through 90° of the bolts which is achieved by a conventional mechanism (not shown), for example a jack or fluid motor mechanism of the link and crank type. The lock and its actuating mechanism have not been described in detail since they are already in use in many container seizing devices and are well-known to those skilled in the art.

Reference will now be made to FIGS. 7 to 10 to explain the operation and use of the seizing device described hereinbefore.

Figure 7:
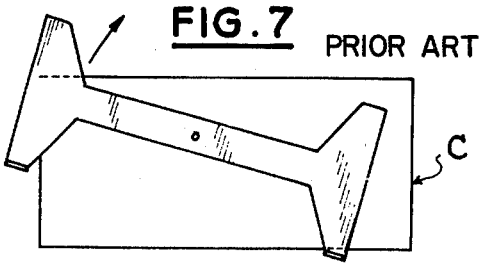
FIG. 7 PRIOR ART
FIG. 7 is a diagrammatic plan view illustrating the positioning movement effected with a seizing device of the prior art.
Figure 8:
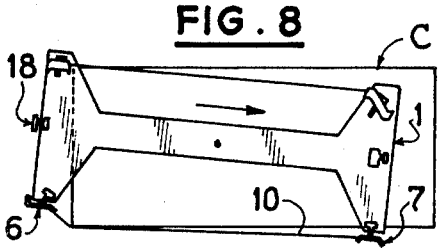
FIG. 8 is a view similar to FIG. 7 illustrating the same operation effected with the seizing device according to the invention.
Figure 9:
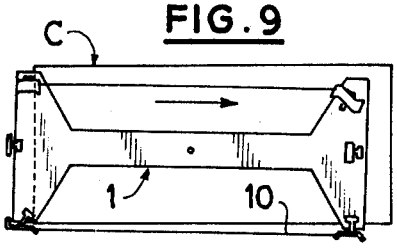
FIG. 9 is a plan view illustrating the pursuance of the movement started in FIG. 8.

As already explained and shown in FIG. 7, the seizing device of the prior art has the drawback of pivoting about its bearing point against the container C to be raised when only one arm is applied against the latter. This drawback is overcome in the device 1 according to the invention, as shown in FIG. 8. In order to position the device 1 relative to a isolated container C, one of the pairs of arms 6, 7 disposed on a large side of the frame 2 are lowered together with that one of the arms 18 which is disposed at the rear with respect to the direction of movement imparted by the handling machine to the seizing device in the direction indicated by the arrow in FIG. 8. It can be seen that the cable 10 interconnecting the lowered arms prevents the rotation of the frame 2 and that, as the movement of translation of the frame 2 in the direction indicated by the arrow continues, the frame 2 tends to place itself in a position parallel to the container C. When the rear arm 6, with respect to the direction of translation of the frame 2, arrives in the vicinity of the adjacent corner of the container C, it can pass round this corner owing to the action of the cable 10 which exerts a pull directly on the end edge of the spatulate portion S owing to the presence of the cross-member 14 and owing to the spatulate portion S which ensures in the last place the passage around the considered corner. The seizing device 1 has then reached the position shown in FIG. 9 and the movement of translation is then continued until the projecting portion 11 of the shoe abuts the small side of the container C, in which position the other arms 6, 7, 18 of the device are lowered so as to complete the positioning of the frame 2 relative to the container C. The frame 2 is then slightly lowered so as to introduce the bolts 19 into the keepers 20, after which the locking is achieved by the bolt-actuating mechanism, and the container can be lifted. Owing to the fact that two of the diagonally opposed shoes 8 have a projecting portion 11, the positioning of the frame 2 in its longitudinal direction can be achieved and positively maintained even if it is impossible to use the arms 18, as is the case, for example, in FIG. 10.

Figure 10:
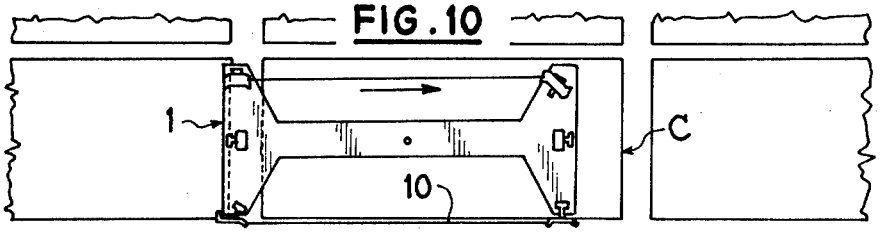
FIG. 10 is a plan view illustrating the movement effected with a seizing device according to the invention in the case where the containers have only a single side free.
Figure 3:
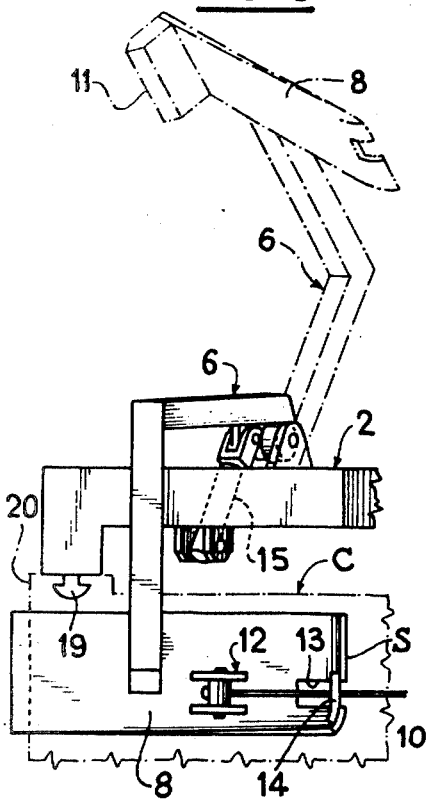
FIG. 3 is an elevational view of a pivotal arm of the seizing device according to the invention, this view being taken parallel to the length of the frame.
Figure 5:
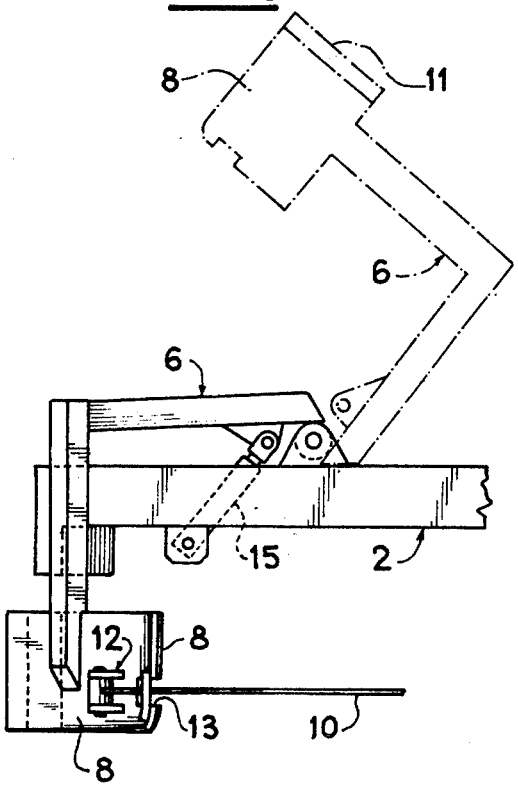
FIG. 5 is an elevational view of the arm shown in FIGS. 3 and 4 but taken in a direction perpendicular to the pivot axis of this arm.

FIG. 10 shows how the positioning of the seizing device 1 can also be achieved even if only a single side of a container C is accessible. Indeed, in this case, the arms 18 disposed on the small sides of the frame 2 cannot be lowered since they would encounter the upper wall of the neighbouring containers and would prevent the arms 6, 7 from ensuring the lateral guiding with effectiveness. Consequently, in such a situation, only the two arms 6, 7 disposed on the free side of the container C are lowered. The seizing device 1 is brought by means of the crane into a position which is such that the two lowered arms 6, 7 are respectively in bearing relation to the container C to be lifted and to the immediately adjacent container, and the seizing device 1 is moved in translation thereafter in a direction indicated by the arrow while slightly urging the device to bear by its arms 6, 7 against the two containers. When the rear arm 6 moves beyond the corner of the container adjacent to that to be lifted, the projection portion 11 of the shoe carried by this arm enters the gap between the two containers and thereafter places itself against the small side of the container C to be lifted and thus immobilizes the seizing device 1 exactly in the position of coincidence above the container C and then enables the aforementioned locking operation to be carried out.

It is clear from the foregoing description that the seizing device according to the invention can be positioned on a container with no outside assistance and within a very short period of time, since the driving of the handling machine to which the device is hooked no longer requires any special precaution and the precision of the positioning is no longer necessary at this point. Note also that the guiding action of the cable remains effective with containers which have no side wall. Moreover, the presence of the spring 16 and the shock-absorber 17 enables the shocks of the cable 10 against the container C to be absorbed. These shocks may be due to the oscillations of the frame 2.

It must be understood that the invention is not intended to be limited to the described embodiment and many modifications may be made without departing from the scope of the invention. Thus the seizing device could be employed in applications other than the handling of containers, for example for handling plates, panels or like elements. The locks could then be replaced by other means, for example magnetic, or pneumatic means, etc. . . The shape of the frame and the number of arms carried thereby may be different, and at least some of these arms could be fixed in position instead of being pivotally mounted. Furthermore, the invention is not intended to be limited to the use of a cable since the latter could be replaced by a band or any like flexible and elongated member. This member, or the cable, may be protected on the surface thereof by a sheath or other device.

Having now described my invention what I claim as new and desire to secure by Letters Patent is:

1. A seizing device comprising a frame, means for suspending the frame from handling means for the purpose of bringing the frame into a position of coincidence defined by at least one frame-locating element of a structure to be seized, for example an edge of a container, and at least two arms disposed on a side of the frame and in spaced relation to each other on said side of the frame, the arms being provided for placing alongside the locating element in said position of coincidence, and flexible and elongated guiding means interconnecting the arms and capable of contacting and cooperating with the locating element so as to guide the frame toward said position of coincidence.

2. A device as claimed in claim 1, wherein said arms are pivotally mounted on the frame and actuating means are combined with said arms for pivoting said arms between a raised position in which the arms are completely inscribed within the contour of the frame and a lower position in which the arms are capable of cooperating with said locating element.

3. A device as claimed in claim 2, wherein each arm is cranked and has an outer end portion and a shoe which is capable of bearing against the locating element is mounted on said end portion and terminates at at least one of the ends of the shoe in a spatulate portion which is curved outwardly of the frame.

4. A device as claimed in claim 3, wherein said spatulate portions of the shoes extend toward each other and each spatulate portion defines a slot through which said guiding means extends and means are provided for retaining the guiding means in the associated slot, the guiding means being fixed to the shoes at opposite ends of the guiding means.

5. A device as claimed in claim 4, wherein the guiding means is fixed to the associated shoe by an elastically-yieldable means at at least one of the ends of the guiding means.

6. A device as claimed in claim 5, wherein a shock-absorbing means is mounted in parallel with the elastically-yieldable means and interposed between the guiding means and the associated shoe.

7. A device as claimed in claim 5, comprising a second locating element which is combined with and defines with the first-mentioned locating element two sides of a right-angled structure, one of said shoes carrying, at an end of the shoe opposed to the spatulate portion, a projecting portion which is disposed at right angles to the shoe and is capable of cooperating with the second locating element, the arm corresponding to said one shoe being mounted to pivot about an axis which is oblique relative to said side of the frame, said frame having a second side which defines with said side a corner of the frame, said arm corresponding to said one shoe being located at said corner.

8. A device as claimed in claim 7, wherein the other of said shoes has, at another end thereof, another spatulate portion which is outwardly curved.

9. A device as claimed in claim 1, comprising two pairs of said arms each pair of which are interconnected by a guiding means, each pair of arms and the associated guiding means being disposed along one of two opposite and parallel sides of the frame.

10. A device as claimed in claim 9, wherein the frame comprises two other sides which are parallel to each other and perpendicular to the first-mentioned sides, and a pivotally mounted positioning arm is also mounted in the middle of each of said other sides.

11. A device as claimed in claim 9, wherein opposed arms of said pairs of arms diagonally of the frame are identical.

12. A device as claimed in claim 1, wherein the flexible and elongated guiding means comprises a cable.

* * * * *